US008448948B1

(12) United States Patent
Shoemaker, Jr.

(10) Patent No.: US 8,448,948 B1
(45) Date of Patent: May 28, 2013

(54) VERTICALLY ARRANGED ARCADE GAME

(71) Applicant: Stephen P. Shoemaker, Jr., Redondo Beach, CA (US)

(72) Inventor: Stephen P. Shoemaker, Jr., Redondo Beach, CA (US)

(73) Assignee: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 13/631,151

(22) Filed: Sep. 28, 2012

(51) Int. Cl.
*A63F 9/00* (2006.01)

(52) U.S. Cl.
USPC ..... 273/447; 273/448; 273/459; 273/460; 273/454

(58) Field of Classification Search
USPC ..... 273/440, 447, 448, 454, 459, 460
See application file for complete search history.

(56) References Cited

U.S. PATENT DOCUMENTS

| | | | | |
|---|---|---|---|---|
| 4,272,082 | A | 6/1981 | Shoemaker, Jr. et al. | |
| 4,303,248 | A | 12/1981 | Shoemaker, Jr. et al. | |
| 4,726,585 | A | 2/1988 | Shoemaker et al. | |
| 4,822,045 | A | 4/1989 | Shoemaker et al. | |
| 5,553,865 | A | 9/1996 | Shoemaker et al. | |
| 5,855,374 | A | 1/1999 | Shoemaker et al. | |
| 6,095,519 | A | 8/2000 | Shoemaker et al. | |
| 6,139,429 | A | 10/2000 | Shoemaker et al. | |
| 6,315,157 | B1 * | 11/2001 | Halliburton | 221/87 |
| 6,598,881 | B1 | 7/2003 | Shoemaker, Jr. | |
| 6,770,001 | B1 * | 8/2004 | Shoemaker, Jr. | 473/447 |
| 6,991,230 | B1 | 1/2006 | Shoemaker | |
| 7,168,702 | B1 | 1/2007 | Shoemaker | |
| 7,600,760 | B2 * | 10/2009 | Matsuda et al. | 273/447 |
| 7,857,318 | B1 * | 12/2010 | Shoemaker et al. | 273/448 |
| 8,016,292 | B1 * | 9/2011 | Yang et al. | 273/451 |
| 8,070,167 | B1 * | 12/2011 | Shoemaker, Jr. | 273/447 |
| 8,079,597 | B1 * | 12/2011 | Wei | 273/451 |
| 8,167,311 | B1 * | 5/2012 | Wang | 273/451 |
| 8,210,538 | B2 * | 7/2012 | Shoemaker, Jr. | 273/288 |
| 2003/0011133 | A1 * | 1/2003 | Uedono et al. | 273/447 |
| 2008/0242413 | A1 * | 10/2008 | Matsuda | 463/38 |

* cited by examiner

*Primary Examiner* — Raleigh W Chiu
(74) *Attorney, Agent, or Firm* — Fulwider Patton LLP

(57) ABSTRACT

An amusement game such as those found in arcades is disclosed having a housing, player controls, and a playing area surrounded by a transparent housing, the game comprising a vertical array of targets; an actuator movable in X, Y, and Z directions, player controls for moving the actuator in the X and Y directions, means for extending the actuator in the Z direction toward the vertical array of targets, a suction device for adhering the actuator to a target. The actuator moves toward the targets and can remove a target from its position if properly aligned by the player.

13 Claims, 4 Drawing Sheets

FIG. 6
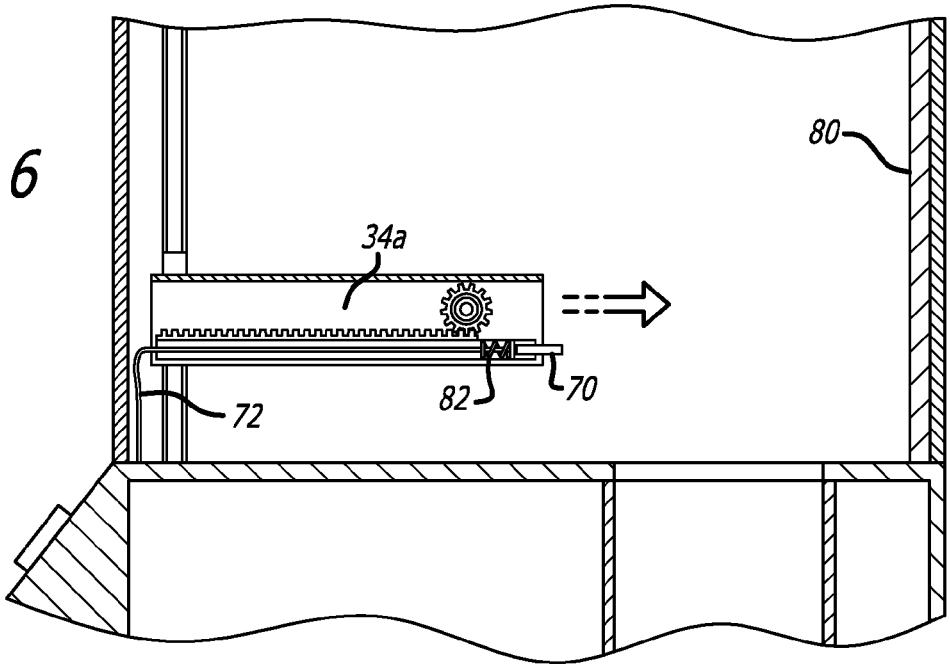
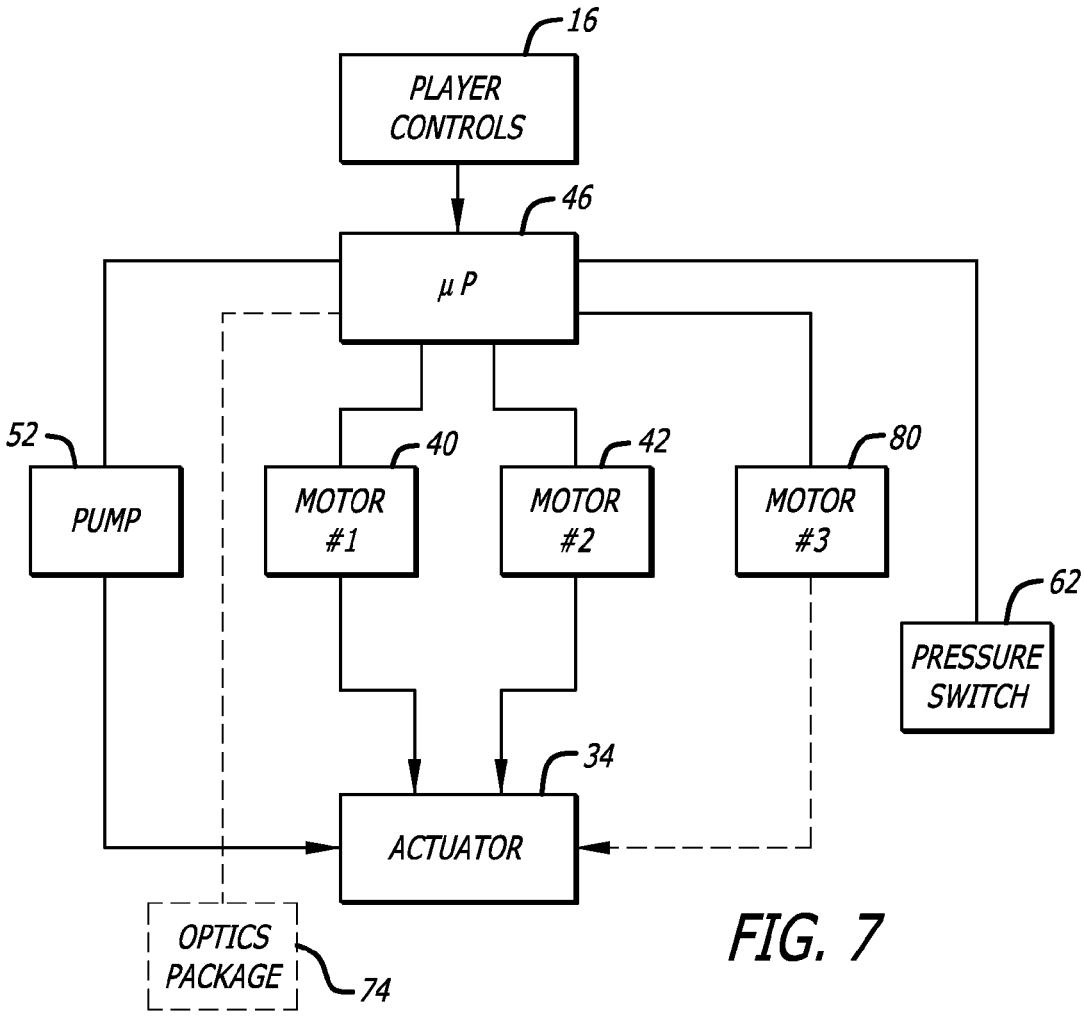
FIG. 7

VERTICALLY ARRANGED ARCADE GAME

BACKGROUND

The present invention relates generally to arcade style entertainment apparatus, and more particularly to a coin or token actuated amusement game wherein a player uses a joystick or other control device to maneuver an actuator in a vertical plan in an attempt to align the actuator with a prize, display image, or target arranged within a playing area. Once the player aligns the actuator, the actuator moves in a horizontal direction and a determination is made as to whether the alignment was successful or not. Based on this determination, the player can be rewarded with a prize, redemption tickets, or the like.

Arcade games that measure a player's skill and luck are well known in the art. The present inventor is the named inventor of many popular games found in today's arcades. For example, U.S. Pat. No. 4,272,082, entitled "Coin Projecting Amusement Device," discloses an amusement wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory which is then unloaded to vend out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin. U.S. Pat. No. 4,822,045 is directed to an amusement device comprised of a pair of spaced apart elongate members defining a track, and a rolling member for rolling along that track under control of an operator. The elongate members are spaced a fixed distance apart at their first ends establishing the normal home position of the rolling member. The opposite, second ends of the elongate members are moveable relative to one another to adjust their spacing and to control the movement of the rolling member along the track. The operator controls the separation of the elongate member so that the rolling member can roll from its home position to the opposite end of the track without falling between the opening separating the elongate members.

U.S. Pat. No. 5,553,865 discloses a rotary arcade game including a turn table having a central aperture. Prizes are positioned on the surface of the turn table and moved by a pivoting arm member operated by the player. The player attempts to manipulate an arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turn table, and the player manipulates a vacuum pick up device linearly along a radial direction of the turn table to pick up prizes below. U.S. Pat. No. 6,139,429 discloses another crane game using a video screen for displaying images. A maneuverable sensor contacts the display screen to select prizes displayed thereon. U.S. Pat. No. 6,095,519 discloses an arcade game including a directing mechanism for aiming a game piece such as a token. U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

U.S. Pat. No. 6,991,230 discloses an amusement device in the form of an arcade game that comprises a rotating playing field arrayed with targets at the perimeter. Using a projectile such as a token or coin, the player drops the projectile into a chute in an attempt to knock down the targets on the rotating playing field. If the player knocks over a target with the projectile, the target is recognized by a detector and then returned to its original position for subsequent play.

U.S. Pat. No. 7,168,702 invented by the present inventor discloses an arcade type amusement device wherein a projectile such as a token is aimed at a target via a guidance mechanism such as an elongate chute. A deflector may be used to alter the path of the projectile, where the deflector is intermittently present along the trajectory of the projectile so as to require timing to engage the deflector. Upon a successful strike of the target, a ball is released down a helical track toward a rotating playing field interspersed with holes assigned various values. When a ball reaches the rotating playing field, it will rebound and roll until it falls within one of said holes, whereupon a point value is awarded based on the particular value of the hole. The player may receiver redemption tickets or points based on the point value awarded.

The foregoing illustrate some of the many arcade type games credited to the present inventor. The games are predominantly skill-based with an element of luck woven into the overall operation of the games. The present invention is the inventor's most recent creation in this line of arcade type games.

SUMMARY OF THE INVENTION

The present invention is an arcade type game in which a joystick, buttons, or other controllers are used by a player to manipulate an actuator (such as a pointer, light source, light receiver, projectile, vacuum source, or the like) in a vertical plane with respect to an array of targets within a playing field. The array of targets are arranged vertically, preferably against a rear wall of the playing field, where the playing field is defined by a transparent housing. The movement of the actuator in an X-Y (vertical) plane may be constant and "stopped" by the player, or the player's control of the joystick or other controller may cause the actuator to move within the vertical (X-Y) plane. The objective is to align the actuator with one of the targets within the array in the horizontal direction. Once the player is satisfied with the alignment (or if the game provides only one opportunity without any adjustment), then the actuator is moved forward toward the target. The target may include a sensor that determines if the target is hit, which may be a light sensor, a pressure sensor, a touch screen, a display screen, or the actuator may physically contact the target itself if the target is a prize, latch, or other moveable object. In the latter case, a vacuum source may make contact with the prize/target if successfully aligned to "capture" the prize by pulling it off its support, pulling a lever to dispense a prize, or in some other manner move the target toward to the player. The skill level of the game can be adjusted by limiting the control the player has over the adjustment of the actuator, such as preventing the actuator from halting in the left to right direction but allowing the player to stop the actuator in the vertical direction, or vice versa. Once the determination of the success of the player is determined, the game may distribute tickets or prizes or the like. In some cases, the target array may need to be replenished if the targets are themselves prizes.

BRIEF DESCRIPTION OF THE DRAWINGS

FIG. 6 is an enlarged, cross-sectional side view of an alternate embodiment; and FIG. 7 is a schematic diagram of elements of the arcade game.

DETAILED DESCRIPTION OF THE PREFERRED EMBODIMENTS

The present invention is an arcade type game wherein a player pays a token, coin, bill, game card, or other unit of exchange in return for an opportunity to play the game. In order to accept payment for the playing, the game includes either a coin slot, card reader, bill reader, or some mechanism for collecting and recognizing payment of the game. Once payment is made and the game recognizes and accepts the payment, then the game is ready for a play, which is an attempt to hit a target arranged in a vertical array.

Figure 1:
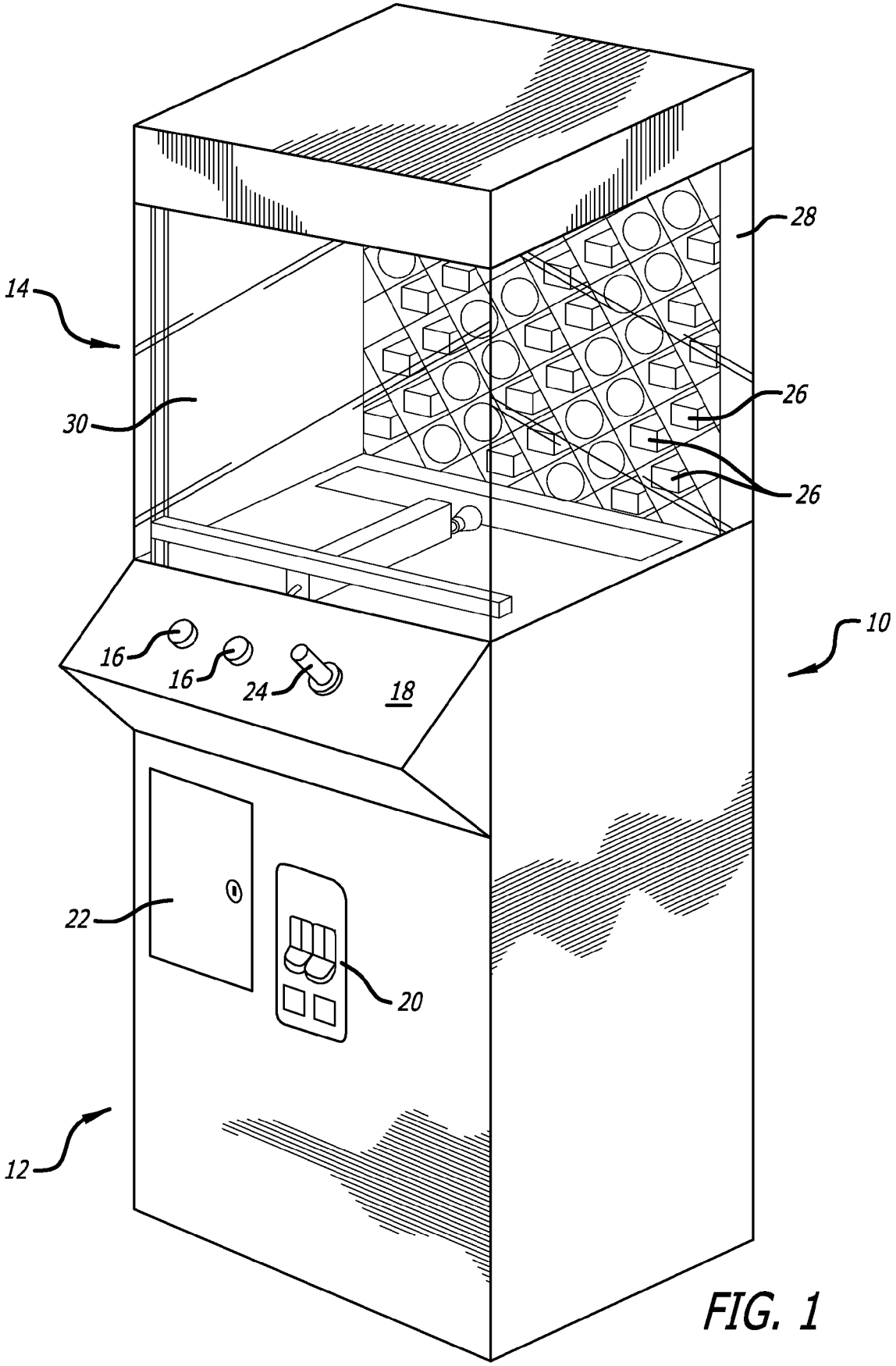
FIG. 1 an elevated, perspective view of an embodiment of the present invention.

FIG. 1 is a perspective view of a first embodiment of the present invention, which includes a housing 10 that is formed with a bottom half 12 that includes the electronics of the game, and an upper half 14 that houses the playing area. The bottom half 12 of the housing 10 includes player controls 16 on a control panel 18 that operate the game, a coin slot 20 or card reader for payment receipt of the game, a prize window 22 for accessing a prize bin to retrieve prizes won by the player, a ticket dispenser (not shown), and possibly speaker (not shown) for playing music (optional). The player controls can include a joystick 24 for controlling the movement of the actuator, and one or more buttons 16 for horizontal deployment of the actuator. Of course, the joystick 24 can be replaced by other types of controls, including buttons, touchpads, rollers, levers, etc.

Within the playing area 14 is an array of prizes or targets 26 arranged against a rear wall 28 of the playing field 14. The playing field 14 is surrounded by a plexi-glass enclosure 30 that allows the player to see into the playing field 14 but prevents a player from tampering with the operation of the game. The targets 26 can be either sensors, a screen, a display screen, or actual physical objects. In the case of a sensor, the targets may simply be a light sensor or display screen that is detected by the sensor at the end of the actuator. The targets may be illuminated areas on a screen mounted to the rear wall of the playing field, such that if the actuator makes contact with the illuminated area, the light sensor determines that a successful "hit" has occurred and the player has won the attempt. Here, the screen may flash various targets such as prizes, logos, pictures, or the like, and the flashing target may be singular or plural, stationary or moving, flashing or constant. In one embodiment, the player must 'guess" where the target will appear to win the attempt, whereas in another embodiment the target remains stationary and the player must align the actuator so as to hit the stationary target. The former represents more of a game of chance, whereas the latter represents more of a game of skill.

FIGS. 2-5 illustrate another embodiment of the present invention, including the use of a vacuum mechanism 32, such as a vacuum tube connected to a plunger mechanism that is at the tip of the actuator 34. In this embodiment, the player tries to manipulate the actuator 34 in the vertical (Y direction) and/or left-to-right (X direction) using the player controls 16 including the joystick 24 so that the actuator 34 is aligned with a target 26 on the back wall 28 of the playing field 14. The targets 26 attached to the prize can be different sizes, creating different levels of difficulty, where smaller shapes are more difficult to obtain than larger shapes. The target 26 preferably has a surface that allows flush contact with the suction of the vacuum mechanism 32, such that the target/prize 26 can be adhered to and "pulled" off its support 36 and into a collection bin 38 at the bottom of the playing field 14. For example, targets 26 may include prizes (watches, radios, MP3 players, etc.) in boxes 26*a* that have a surface area just large enough to receive a plunger or a vacuum port. Alternatively, special containers shaped like tubes or spheres 26*b* can be used that enclose a prize therein. If the player successfully manipulates the actuator 34 so as to align the vacuum port or plunger 32 against the target's surface area so that the plunger/vacuum port makes effective contact with the prize/target 26, then the plunger 32 will adhere to the target prize 26 and as the actuator 34 recedes the vacuum source is deactivated to allow the prize 26 to fall into the retrieval bin 38.

The invention utilizes a positioning system that controls the actuator in the X-Y direction, where X refers to the left to right, and Y refers to the top to bottom. A pair of motors 40, 42 can be used that drive belts 44, which in turn position the actuator 34 according to input from the player via the joystick 24. The joystick 24 (or other input device) is connected to a processor 46 that turns the motors 40, 42 on and off, and controls the direction of the motors 40,42, which in turn controls the position of the actuator 34. Note that there are variations on the control of the actuator 34, which may be solely controlled by the player, jointly controlled by the player and the processor 46, or solely controlled by the processor 46 in a random or predictable manner. For example, the processor 46 may control the movement of the actuator in the X direction, moving the actuator from the far left side to the far right side and back again, while the player controls only the Y direction (or vice versa). Or the processor controls the movement of the actuator in the X-Y direction, and the player selects the movement in the Z direction when the actuator is aligned with a target. Alternately, the player controls all movement of the actuator in the X, Y, and Z directions.

Figure 2:
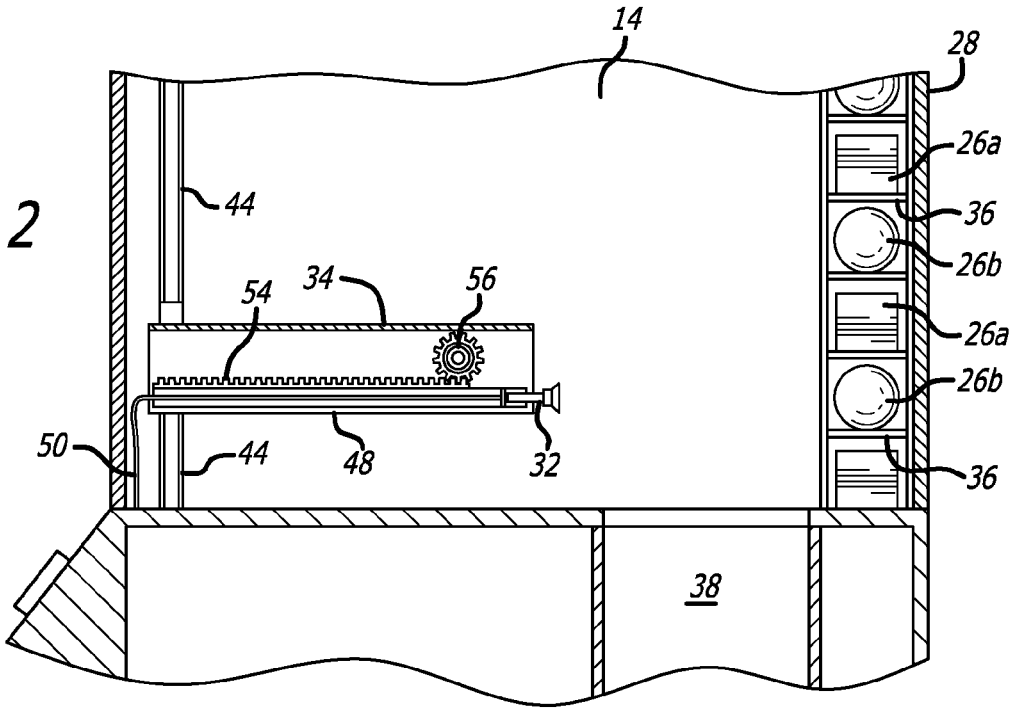
FIG. 2 is an enlarged, cross-sectional side view of an embodiment of the present invention.
Figure 3:
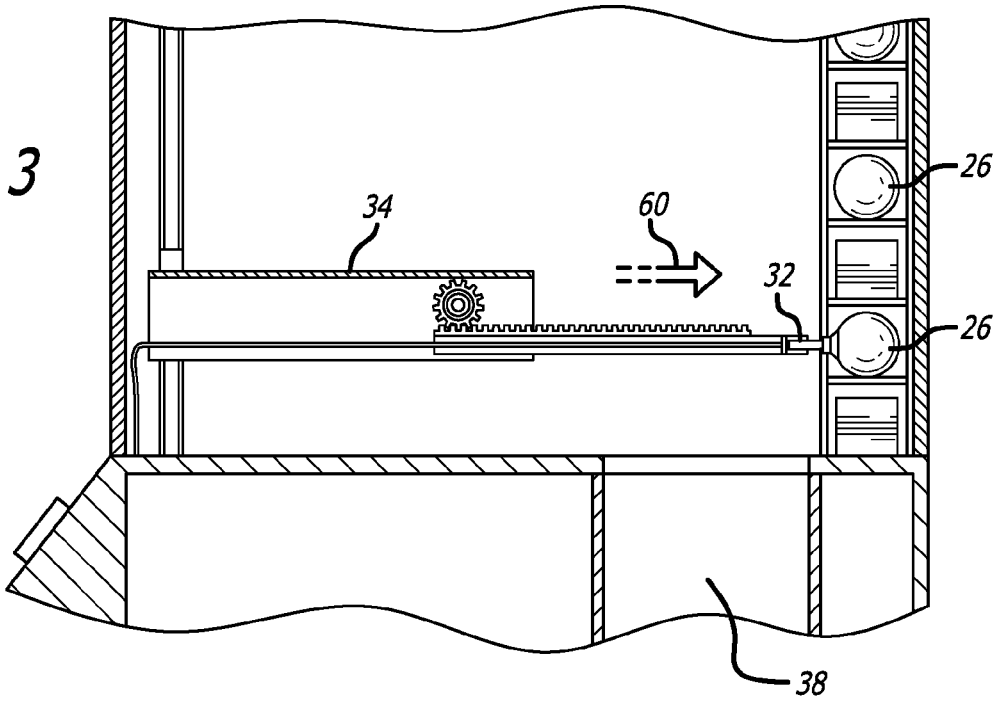
FIG. 3 is an enlarged, cross-sectional side view of the embodiment of FIG. 2 with the actuator deployed.
Figure 4:
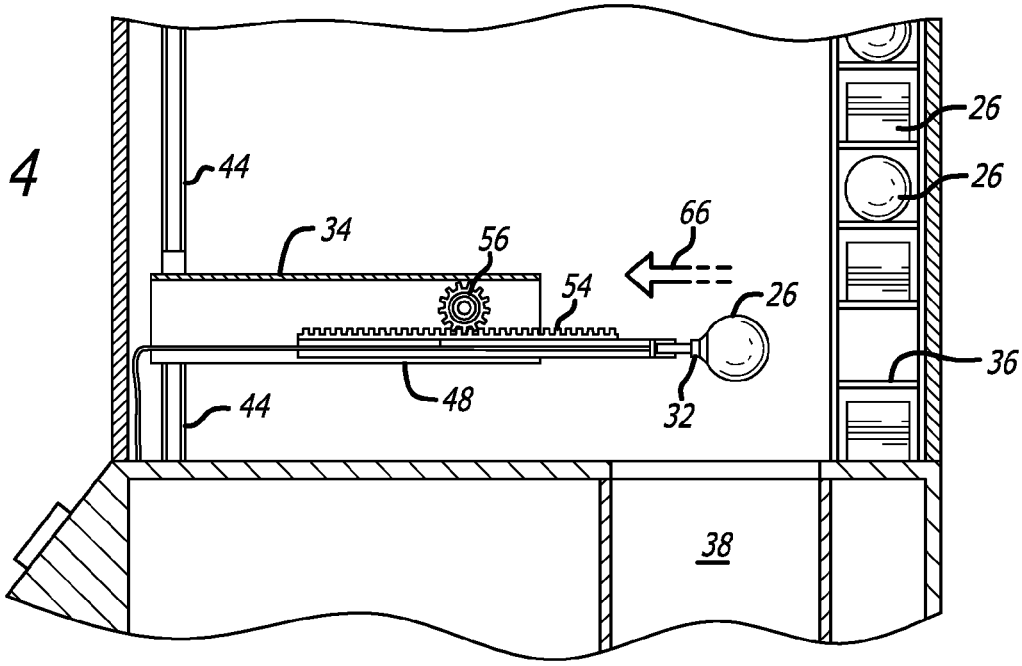
FIG. 4 is an enlarged, cross-sectional side view of the embodiment of FIG. 2 with the actuator retracting.
Figure 5:
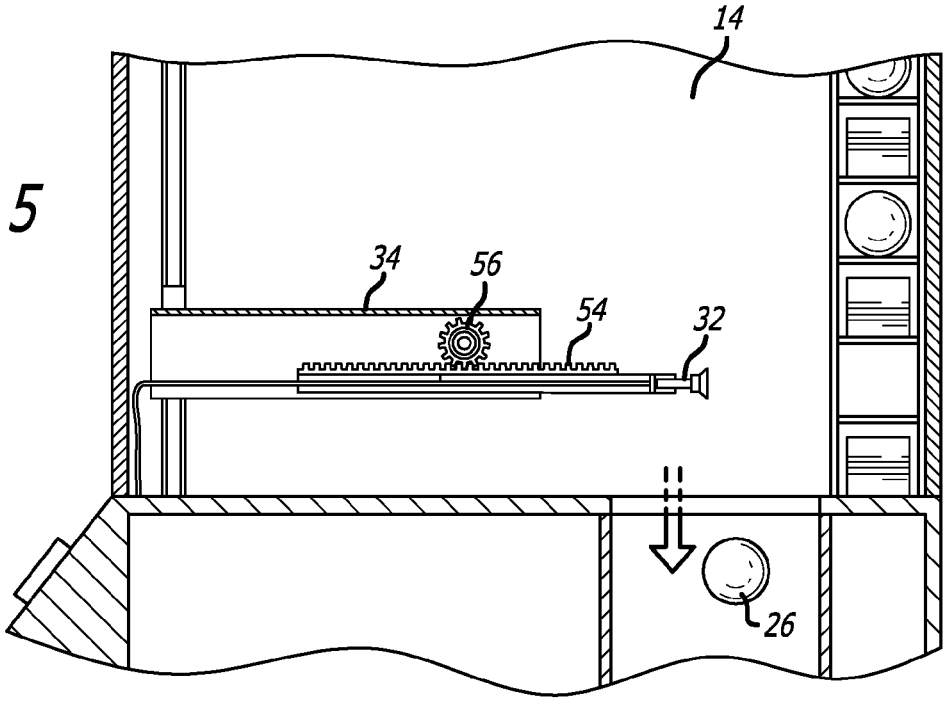
FIG. 5 is an enlarged, cross-sectional side view of a prize being deposited in a retrieval compartment.

FIG. 2 illustrates an actuator 34 that is controlled by a rack and pinion drive system, that moves the actuator in the Z direction. Other mechanical systems to project the actuator are also envisioned. The actuator 34 can comprise a cylindrical body 48 (where cylindrical is broadly understood to mean any cross-section) that houses a vacuum hose 50, which in turn is connected to a vacuum source 52 located in the game's housing 10. At the distal end of the actuator cylindrical body 48 is a vacuum adapter, such as a plunger 32 selected to mate with the target(s) 26 of the game. The cylindrical body 48 of the actuator 34 is equipped with a worm gear 54, which mates with a drive gear 56 to maneuver the actuator 34 linearly toward and away from the target 26 (the "Z" direction). A pneumatic system can be substituted for the gear system, where an air cylinder moves the actuator in response to a pressure source. The processor 46 controls a motor 80 that actuates the drive gear 56, such that when the player elects to move the actuator 34 toward the target 26, such as via a commence button on the control panel 18, the XY movement of the actuator 34 ceases and the drive gear 56 engages and drives the worm gear 54 to move the actuator 34 toward the target in the direction of arrow 60. The actuator can be equipped with a switch 62 adjacent the distal end, which can be used to cut off the suction from the vacuum source 52 when the actuator 34 recedes after making contact with the target 26 in the direction of arrow 66, allowing the prize 26 to fall in to the retrieval bin 38 as shown in FIGS. 4 and 5. The switch 62 can be controlled by the processor 46, the position of the actuator 34, or the position of the worm gear 54.

FIG. 6 shows an alternate embodiment of an actuator 34*a* that uses a light sensor 70 to evaluate whether the player has made a successful try at the game. The actuator 34*a* uses a similar rack and pinion drive system as before, but the cylindrical body 48 carries a cable 72 capable of carrying signals instead of a vacuum tube. The cable 72 is connected to an optics package 74 disposed at the distal end of the actuator cylindrical body, where the cable is connected at the proximal end to the processor. The optical package 74 is capable of determining light and, if light is detected, a signal is sent to the processor 46 indicating the presence of light. This actuator 34*a* can be used in connection with a screen 80 where targets are illumination against an otherwise dark background. Only the target is illuminated, and thus when the actuator 34*a* reaches the screen if the target is missed then no light will be observed and the attempt fails. However, if the actuator reaches the screen 80 and the optical sensor 70 is against an illuminated portion of the screen 80, then the optics package 74 sends a signal via the cable 72 to the processor 46 to indicate that a successful attempt has occurred.

To protect the optical sensor 70 and/or the screen 80, the actuator 34*a* may include a safety spring 82 that prevents the full force of the drive system from engaging the screen 80 at the distal end of the actuator 34*a*. That is, as the distal end begins to make contact with the screen 80, the safety spring 82 absorbs some of the energy as it compresses, softening the impact of the actuator 34*a* with the screen 80. Other energy absorbing mechanisms can also be substituted for the spring that prevents the full force of the drive system from impacting the screen.

Yet another embodiment of the game is to have the actuator simply be a pointer with a soft tip, that makes contact with a pressure sensitive screen displaying various targets. The pressure sensitive screen can detect whether the actuator has made contact within the boundary of the target, and thereby determine whether the player has made a successful attempt.

While specific embodiments of the present invention have been described above, it should be understood that other variations are readily appreciable and that the invention should not be limited to those above-described embodiments. Rather, the invention should be considered to include all variations and modifications that would be understood by one of ordinary skill in the art. Accordingly, the scope of the invention is not limited by any drawing or description, but rather the words of the appended claims using their plain and ordinary meanings in view of the descriptions and drawings.

I claim:

1. An amusement game having a housing, player controls, and a playing area surrounded by a transparent housing, the game comprising:

a vertical array of targets;

an actuator movable in X, Y, and Z directions;

player controls for moving the actuator in the X and Y directions;

means for extending the actuator in the Z direction toward the vertical array of targets;

a suction device for adhering the actuator to a target;

means for retracting the actuator once it has adhered to the target to pull the target off its vertical array and into a collection bin; and a door to access the target within the collection bin.

2. The amusement game of claim 1 wherein the means for extending the actuator is a rack and pinion drive system.

3. The amusement game of claim 2 wherein the rack and pinion drive system is actuated by a motor.

4. The amusement game of claim 1 further comprising a microprocessor that receives input from the player controls and sends signals to move the actuator according to the signals.

5. The amusement game of claim 1 wherein the suction device is a plunger that is connected to a vacuum source.

6. The amusement game of claim 1 wherein the targets are prizes inside containers selected to mate with the suction device.

7. The amusement game of claim 6 wherein the containers are spherical.

8. The amusement game of claim 1 further comprising first and second motors for moving the actuator in the X and Y directions, respectively.

9. The amusement game of claim 1 further comprising a pressure switch that disconnects the suction device once a target is above a collection bin.

10. The amusement game of claim 1 wherein a microprocessor controls movement of the actuator in the X direction and a player controls movement of the actuator in the Y direction.

11. The amusement game of claim 1 wherein the microprocessor controls movement of the actuator in the Y direction and the player controls movement of the actuator in the X direction.

12. The amusement game of claim 1 wherein a player controls movement of the actuator via the player controls in the X and Y directions.

13. The amusement game of claim 1 wherein a prize is connected to a target.

* * * * *